US007954174B2

(12) United States Patent
Kume et al.

(10) Patent No.: US 7,954,174 B2
(45) Date of Patent: Jun. 7, 2011

(54) CATCHING TOOL FOR BASEBALL OR SOFTBALL

(75) Inventors: Kazuhiro Kume, Osaka (JP); Takashi Ono, Osaka (JP)

(73) Assignee: Mizuno Corporation, Osaka (JP)

( * ) Notice: Subject to any disclaimer, the term of this patent is extended or adjusted under 35 U.S.C. 154(b) by 251 days.

(21) Appl. No.: 12/327,238

(22) Filed: Dec. 3, 2008

(65) Prior Publication Data

US 2009/0300814 A1 Dec. 10, 2009

(30) Foreign Application Priority Data

Dec. 3, 2007 (JP) ..... 2007-312586

(51) Int. Cl.
*A63B 71/14* (2006.01)
*A41D 19/00* (2006.01)

(52) U.S. Cl. ..... 2/159; 2/158; 2/161.1; 2/161.6; 2/161.7

(58) Field of Classification Search ..... 2/19, 158, 2/159, 161.1, 161.6, 161.7, 168, 169
See application file for complete search history.

(56) References Cited

U.S. PATENT DOCUMENTS

| | | | | |
|---|---|---|---|---|
| 4,477,927 | A * | 10/1984 | Tsubota et al. | 2/19 |
| 5,075,899 | A * | 12/1991 | Funahashi et al. | 2/19 |
| 5,584,133 | A * | 12/1996 | Motooka et al. | 40/642.02 |
| 6,219,844 | B1 * | 4/2001 | Yamada et al. | 2/19 |
| 6,305,022 | B1 * | 10/2001 | Oomura et al. | 2/19 |
| 6,678,899 | B2 * | 1/2004 | Fiorini et al. | 2/463 |
| 6,826,786 | B2 * | 12/2004 | Fiorini et al. | 2/463 |
| 2002/0031626 | A1 * | 3/2002 | Ohira et al. | 428/35.7 |
| 2002/0144332 | A1 * | 10/2002 | Nishimura et al. | 2/19 |
| 2005/0022282 | A1 * | 2/2005 | Motooka et al. | 2/19 |
| 2006/0200886 | A1 * | 9/2006 | Tsukamoto et al. | 2/19 |
| 2010/0122396 | A1 * | 5/2010 | Kato | 2/161.1 |

FOREIGN PATENT DOCUMENTS

| | | |
|---|---|---|
| JP | 58-221901 | 12/1983 |
| JP | 61-143081 | 6/1986 |
| JP | 63-186474 | 11/1988 |
| JP | 2006-239402 | 9/2006 |

* cited by examiner

*Primary Examiner* — Bobby H Muromoto, Jr.
(74) *Attorney, Agent, or Firm* — Troutman Sanders LLP; James E. Schutz; Robert R. Elliott, Jr.

(57) ABSTRACT

Disclosed is a catching tool for baseball or softball including a ball receiving portion covering the palm side of a user's hand when wearing the tool and containing a ball receiving surface for receiving a ball, a resin layer that is selectively formed on the surface of the ball receiving portion and can be deformed along a surface of the ball when catching the ball, and a back portion for covering the back of the user's hand. On the ball receiving portion, various resin layers may be optionally formed, examples of the resin layers including a large-width resin layer, and a small-width resin layer having a convex regions.

15 Claims, 11 Drawing Sheets

CATCHING TOOL FOR BASEBALL OR SOFTBALL

BACKGROUND OF THE INVENTION

1. Field of the Invention

The present invention relates to a catching tool for baseball or softball, more specifically, a catching tool for baseball or softball wherein a resin layer is formed on a surface of a ball receiving portion for covering the palm side of a person who is to have the tool on.

2. Description of the Background Art

Hitherto, known has been a catching tool wherein a coating film made of synthetic resin is formed on the entire surface of a ball catching surface in order to restrain a ball from dropping down when the ball is caught. Such a catching tool is described in, for example, Japanese Patent Laying-Open Nos. 58-221901 and 61-143081.

Moreover, Utility Model Laying-Open No. 63-186474 describes a glove for baseball wherein an anti-slipping body made of an elastomer is arranged in a ball catching surface to catch a hit ball or the like certainly, and Japanese Patent Laying-Open No. 2006-239402 describes a catching tool wherein a surface of a ball receiving leather is provided with a projected region made of a material different from that of the ball receiving leather in order to prevent the catching miss of a ball.

In the catching tools described in the Japanese Patent Laying-Open Nos. 58-221901 and 61-143081, a coating film made of synthetic resin is formed on the entire surface of their ball catching surface; therefore, the wholes of the catching tools become hard. As a result, when catching a ball, it is difficult that the ball is well grasped. About the catching tools described in these documents, it is difficult that when a ball is caught, the coating film made of synthetic resin is deformed along the ball. For this reason, the Japanese Patent Laying-Open Nos. 58-221901 and 61-143081 never describe the technical idea that "a resin layer formed selectively on the front surface of a ball receiving portion of a catching tool is transformed along a ball, whereby at the time of catching the ball, the slipping of the ball inside the tool is restrained".

In the meantime, the anti-slipping body described in the Utility Model Laying-Open No. 63-186474 is set in small holes in the catching surface. Thus, when a ball is caught, the contact area between the ball and the anti-slipping body becomes small. Similarly, therefore, there is caused a problem that the ball cannot be effectively restrained from slipping when the ball is caught. About the anti-slipping body described in the document also, it can be mentioned that in light of the shape thereof and others, the body is not easily deformed along a ball when the ball is caught. Accordingly, the Utility Model Laying-Open No. 63-186474 never describes the technical idea that "a resin layer formed selectively on the front surface of a ball receiving portion of a catching tool is deformed along a ball, whereby at the time of catching the ball, the slipping of the ball inside the tool is restrained", either.

About the catching tool described in Japanese Patent Laying-Open No. 2006-239402, the contact area itself between its projected region and a ball is relatively small. Therefore, if a person who has the catching tool on can close the tool at a speed planned when the tool is designed, the catching miss of a ball can be avoided and further the slipping of the ball can also be restrained when the ball is caught. However, the tool-opening/closing-speeds attained by persons who may have the tool on are naturally varied; thus, when the opening/closing speed attained by some person is smaller than the value planned in the design of the tool, there is also caused a problem that when a ball is caught, the slipping of the ball inside the catching tool cannot be effectively restrained. The above-mentioned projected region is formed in order to shorten the period when the catching tool is closed, thereby preventing the catching miss of a ball. Thus, the projected region is not any region that is deformed along a ball so as to restrain the slipping of the ball when the ball is caught. Accordingly, this document does not describe the technical idea that "a resin layer formed selectively on the front surface of a ball receiving portion of a catching tool is deformed along a ball, whereby at the time of catching the ball, the slipping of the ball inside the tool is restrained", either.

SUMMARY OF THE INVENTION

The present invention has been made to solve the above-mentioned problems, and an object of the invention is to provide a catching tool for baseball or softball about which at the time of catching a ball, a resin layer is made deformable along the ball, thereby restraining the slipping of the ball effectively, and about which opening and closing operations can easily be made at the ball-catching time.

An aspect of the catching tool for baseball or softball according to the invention includes: a ball receiving portion for covering the palm side of a person who is to have the tool on when the person has the tool on, and containing a ball receiving surface for receiving a ball; first and second resin layers (resin regions) that are each selectively formed on a surface of the ball receiving portion and can be deformed along a surface of the ball when the user catches the ball; and a back portion for covering the back of the person's hand.

The first and second resin layers may contain a linear resin layer formed in a linear form, or may contain a planar resin layer formed in a planar form. The catching tool for baseball or softball may include a third resin layer between the first and second resin layers. In this case, the third resin layer may connect the first and second layers to each other. However, the first and second resin layers may not be connected to each other through the third resin layer. Between any two of the first to third resin layers, or in at least one of the first to third resin layers, a slit, a thin region, or the like for allowing or promoting the deformation of the resin layer(s) may be provided.

At least one of the first, second and third resin layers may contain, at the circumference thereof, a flat region having a flat upper surface. A slit, a thin region or the like may be made in the flat region, thereby dividing or partitioning the region into plural divisions.

The thicknesses of the first and second resin layers may be made different from that of the third resin layer. In many cases, the catching tool contains plural finger stalls for receiving the thumb of the person who is to have the tool on, and the person's fingers other than the thumb, respectively; when the thickness of the third resin layer is made larger than the thicknesses of the first and second resin layers, the third resin layer may be arranged at the root region of at least one of the finger stalls. The third resin layer may be arranged around the ball receiving surface.

About raw materials of the individual resin layers, for example, the raw material of the first resin layer and that of the second resin layer may be made the same or different. The raw material(s) of the first and second resin layers may be made different from that of the third resin layer.

Another aspect of the catching tool for baseball or softball according to the invention includes: a ball receiving portion for covering the palm side of a person who is to have the tool on when the user has the tool on, and containing a ball receiving surface for receiving a ball; a resin layer formed over the whole of the surface of the ball receiving portion, and having an opening that makes a portion of the front surface of the ball receiving portion exposed and is capable of reducing force required when the ball is grasped in the case of catching the ball; and a back portion for covering the back of the person's hand.

The resin layer may contain first and second resin layers positioned on both sides of the opening. The first and second resin layers each preferably have, in an opening-side side surface thereof, a flat plane. The catching tool usually contains plural finger stalls for receiving the thumb of the person who is to have the tool on, and the person's fingers other than the thumb, respectively; it is allowable that the resin layer is provided with a thick region and a thin region, and the thick region is arranged at the root region of the finger stalls. The thick region may be arranged around the ball receiving surface.

A further aspect of the catching tool for baseball or softball according to the invention includes: a ball receiving portion for covering the palm side of a person who is to have the tool on when the user has the tool on, and containing a ball receiving surface for receiving a ball; a first resin pattern formed on the surface of the ball receiving portion; a second resin pattern formed on the surface of the ball receiving portion to be separated from the first resin pattern; a subsidiary resin pattern that is formed between the first and second resin patterns, and is capable of restraining excessive deformation of at least one of the first and second resin patterns when the ball is caught; and a back portion for covering the back of the person's hand.

The subsidiary resin pattern may be connected to either one of the first and second resin patterns. In this case, a slit, a thin region or the like may be made between the other of the first and second resin patterns and the assistant resin pattern. The individual resin patterns may be made of the same resin or different resins.

A still further aspect of the catching tool for baseball or softball according to the invention includes: a ball receiving portion for covering the palm side of a person who is to have the tool on when the user has the tool on, and containing a ball receiving surface for receiving a ball; a mesh-like resin layer formed over the whole of the surface of the ball receiving portion; and a back portion for covering the back of the person's hand. Herein, the mesh-like resin layer refers to "a resin layer having regular or irregular openings over the whole" in the present specification.

A surface portion of the ball receiving surface region may be made of any one of natural leather, artificial leather, synthetic leather and nonwoven fabric. The surface region of the ball receiving portion is preferably made non-flat. For example, the surface region of the ball receiving portion is subjected to surface-roughening treatment, thereby making fine irregularities therein.

In the catching tool for baseball or softball according to the invention, one or more resin layers are selectively formed on the surface of its ball receiving portion; therefore, when the catching tool is opened and closed, resistance based on the resin layer(s) is decreased so that operations for the opening and closing can easily be made. Additionally, when a ball is caught, the resin layer(s) on the surface of the ball receiving portion can easily be deformed along the ball. As a result, the slipping of the ball can be effectively restrained when catching a ball. Furthermore, the catching tool exhibits excellent operability.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

With reference to FIGS. 1 to 9, embodiments of the invention will be described hereinafter.

Embodiment 1

Figure 1:
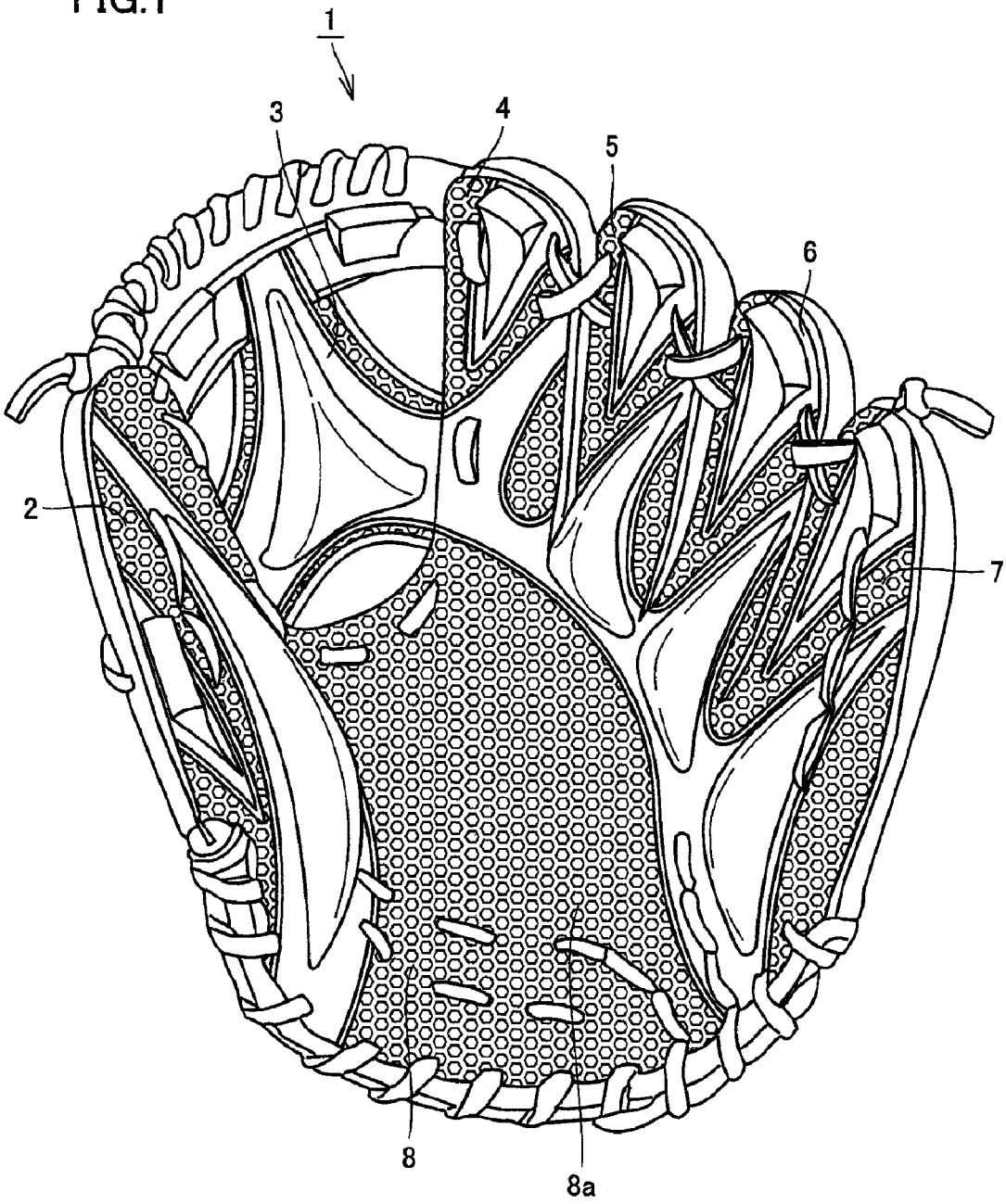
FIG. 1 is a front view of a catching tool for baseball or softball according to Embodiment 1 of the invention.

FIG. 1 is a front view of a catching tool for baseball or softball according to Embodiment 1 of the invention. In Embodiment 1 illustrated in FIG. 1, a glove for baseball or softball is illustrated as the catching tool. However, the invention is applicable to a catching tool other than gloves as far as the catching tool is a tool capable of catching a ball, example of the tool including a catcher's mitt and a first baseman's mitt.

A catching tool 1, which is the catching tool for baseball or softball of Embodiment 1, is provided with, for example, an outer leather and an inner leather inserted into the outer leather. However, such an inner leather may be not given, so that the catching tool may be made only of an outer leather.

The outer leather has a ball receiving portion for covering the palm side of a person who is to have the tool on (i.e., a user) when the user has the tool on, and containing a ball receiving surface for receiving a ball, and a back portion for covering the back of the person's hand when the person has the tool on. The outer leather may be made of natural leather, artificial leather, synthetic leather, nonwoven fabric, or any material equivalent thereto.

In the example illustrated in FIG. 1, the outer leather is formed by sewing a ball receiving member 8 and the back portion together, and has a thumb stall 2 for receiving the thumb of a person who is to have the catching tool on, a forefinger stall 4 for receiving the forefinger of the person, a web unit 3 arranged between thumb stall 2 and forefinger stall 4, a second finger stall 5 for receiving the second finger of the person, a third finger stall 6 for receiving the third finger of the person, and a little finger stall 7 for receiving the little finger of the person.

The inner leather is formed by sewing a palm member positioned on the ball receiving member side and a backside member together. In the same manner as in the outer leather, the palm member and the backside member may also be made of natural leather, artificial leather, synthetic leather, nonwoven fabric, or any material equivalent thereto. In the same manner as in the outer leather, the inner leather has a thumb stall, a forefinger stall, a second finger stall, a third finger stall, and a little finger stall. These finger stalls are inserted into the corresponding finger stalls of the outer leather, respectively, that is, thumb stall 2, forefinger stall 4, second finger stall 5, third finger stall 6, and little finger stall 7 of the outer leather, respectively. A core material may be set between ball receiving member 8 and the palm member. The core material may be made of felt or the like.

Catching tool 1 according to Embodiment 1 can be produced by inserting the inner leather into the outer leather, setting the core material between ball receiving member 8 and the palm member, sewing predetermined portions of the inner leather and the outer leather together, and tying the leathers with a leather strap.

As illustrated in FIG. 1, in catching tool 1 according to Embodiment 1, a resin layer is formed selectively on a ball receiving portion 8*a*, which is a surface of ball receiving member 8 and contains a ball receiving surface. This resin layer may be formed by a resin-molding method such as cast molding. This matter is applied to any embodiment that will be described later. The surface region of ball receiving portion 8 is preferably made non-flat. For example, a surface region of ball receiving portion 8*a* may be subjected to surface-roughening treatment, thereby making fine irregularities, or the surface region may be made soft. Alternatively, a roughened surface layer or a soft layer may be separately formed.

By forming the resin layer selectively on ball receiving portion 8*a* as described above, resistance based on the resin layer is decreased when catching tool 1 is opened and closed. Thus, operations for the opening and closing can easily be made. Additionally, when a ball is caught, the resin layer on the surface of ball receiving portion 8*a* can easily be deformed along the ball. As a result, the slipping of the ball can be effectively restrained at the ball-catching time. Furthermore, the catching tool is a catching tool excellent in operability.

Figure 2:
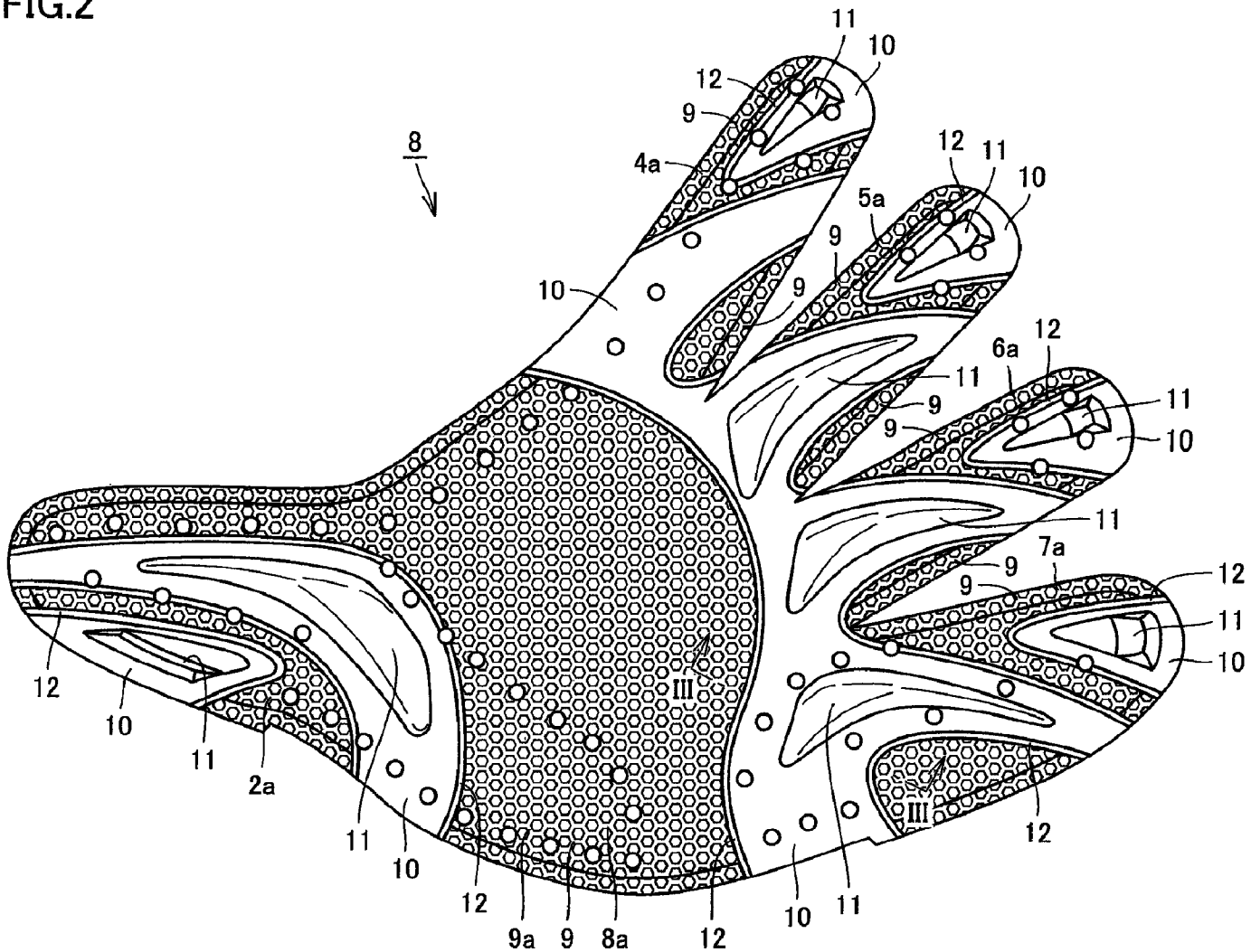
FIG. 2 is a plan view illustrating a state that a ball receiving member of the catching tool illustrated in FIG. 1 is developed.

FIG. 2 is a plan view of a state that ball receiving member 8 is developed. In the example illustrated in FIG. 2, plural resin layers are formed on the surface of ball receiving portion 8*a* so as to be separated from each other. More specifically, a mesh-formed resin layer 9 is formed on the ball receiving surface positioned at the center of ball receiving portion 8*a*, and further other mesh-formed resin layers 9 are formed on both sides of central resin layer 9 to be separated from central resin layer 9. At positions adjacent to central resin layer 9, small-width resin layers (subsidiary resin patterns) 12, which are each a pattern in the form of a line having a small width, and large-width resin layers 10, which are each a pattern in the form of a plane having a large width, are formed. Outside these layers, small-width resin layers 12 and large-width resin layers 10 are formed with mesh-form resin layers 9 interposed therebetween.

For example, resin layers 9 may each have a thickness of about 0.5 to 1.5 mm, and may be made of a thermosetting resin such as urethane resin. Resin layers 9 each have openings 9*a* for making the front surface of ball receiving portion 8*a* exposed. When openings 9*a* are made in this way, resin layers 9 can easily be bent, thereby making it possible to decrease the force required when catching tool 1 is opened and closed. Thus, when a ball is caught, the force required to grasp the ball can be decreased.

In order to make the advantageous effect remarkable, it is preferred that resin layers 9 are made of soft material or the thickness of resin layers 9 is made small. This makes it possible to deform resin layers 9 very easily along a ball when the ball is caught, and further decrease effectively the force required to open and close catching tool 1.

In the example illustrated in FIGS. 1 and 2, the shape of openings 9*a* is hexagonal; however, any shape may be adopted as the shape of openings 9*a*, examples of the shape including a circular shape, and polygonal shapes other than the hexagonal shape. The number, the size and other characteristics of openings 9*a* may be set at will.

In order to keep the peel strength of resin layers 9 from ball receiving portion 8*a* certainly, it is advisable to form resin layers 9 over a wide area of the front surface of ball receiving portion 8*a* to cause them to adhere closely to each other, as illustrated in FIG. 2. According to the manner, the contact area between resin layers 9 and ball receiving portion 8*a* can be certainly kept so that the peel strength of resin layers 9 from ball receiving portion 8*a* can be certainly kept. In the case, where resin layers 9 are formed over the wide area, impact given by a ball when the ball is caught can be dispersed. From this viewpoint also, the peel strength of resin layers 9 from ball receiving portion 8*a* can be certainly kept.

As illustrated in FIGS. 1 and 2, resin layers 9 may each be regarded as a layer having a pair of resin patterns that are positioned on both sides of openings 9*a* and are each in the form of a thin line, and a connecting resin pattern for connecting (jointing) the patterns of this linear resin pattern pair to each other. When the patterns of the linear resin pattern pair are connected to each other through the connecting resin pattern in this way, close adhesion area between resin layers 9 and ball receiving portion 8*a* can be increased, and additionally sites that may become starting points when resin layers 9 are peeled can be decreased to improve the peel strength.

Apart from the above, the patterns of the linear resin pattern pair may be separated from each other by eliminating the connecting resin pattern, making a slit (gap) in the connecting resin pattern, or making some other operation. In this case, resin layers 9 can be more easily bent (deformed) so that the operability of catching tool 1 can be further improved.

It is also preferred to form resin layers 9 to be deformable over a wide area of the surface of ball receiving portion 8*a*. In this way, resin layers 9 can be deformed along a ball when the ball is caught, so that the ball can be surrounded with resin layers 9. As a result, the contact area between resin layers 9 and the ball can be increased at the ball-catching time. Thus, the ball can be more effectively restrained from slipping when caught.

Each of resin layers 9, and small-width resin layer 12 and large-width resin layer 10 corresponding thereto may be connected to each other; however, between any two of the layers, a slit (gap) or a thin wall portion permitting the two resin layers to be deformed may be located. For example, at least one of the spaces between resin layer 9 and small-width resin layer 12 and between small-width resin layer 12 and large-width resin layer 10, a slit, a thin region or the like may be arranged. In this way, the resin layers or the catching tool can easily be bent at the position where the slit (gap), the thin region or the like is arranged.

Figure 3:
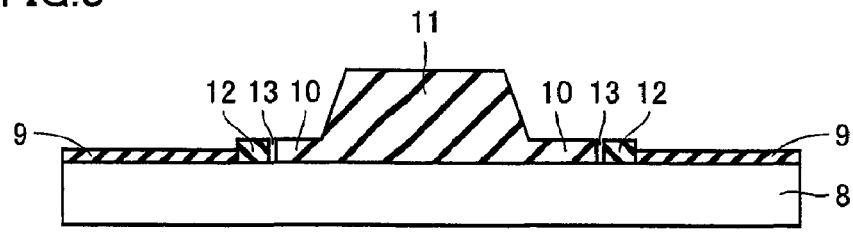
FIG. 3 is a view schematically illustrating a cross section structure of the catching tool taken along line III-III in FIG. 2.

FIG. 3 schematically illustrates a cross section structure taken along line III-III in FIG. 2. As illustrated in FIG. 3, in Embodiment 1, a slit (gap) 13 is made between each of small-width resin layers 12 and large-width resin layer 10 adjacent thereto. A convex region 11 is formed at the center of large-width resin layer 10. In the case, where convex region 11 is formed in large-width resin layer 10 and further slit 13 is made between small-width resin layer 12 and large-width resin layer 10 as described above, large resin patterns such as convex region 11 and large-width resin layer 10 are permitted to be deformed to some degree when a ball is caught to be hit onto convex region 11. Thus, the degree of concentration of stress onto the circumference can be decreased while excessive deformation thereof can also be restrained. As a result, the peel strength of convex region 11 and large-width resin layer 10 from ball receiving portion 8*a* can be improved. In short, small-width resin layer 12 functions as an subsidiary resin pattern capable of assisting convex region 11 and large-width resin layer 10. The thickness of small-width resin layers 12 and that of resin layers 9 may be, for example, about 0.5 to 1.5 mm, and the thickness of large-width resin layers 10 may be, for example, a value larger than the thicknesses of small-width resin layers 12 and resin layers 9, specifically, a value from about 1.5 to 3.0 mm. The thickness of convex regions 11 may be, for example, a value larger than the thicknesses of small-width resin layers 12, large-width resin layers 10 and resin layers 9, specifically, a value from about 6.0 to 9.0 mm.

As illustrated in FIG. 3, one side of each of small-width resin layers 12 is connected to one of resin layers 9, and at the other side of small-width resin layer 12, slit 13 is made. Small-width resin layer 12 is formed to surround convex region 11, which is a thick region, and large-width resin layer 10. Resin layer 9, which is a thin region, is formed around small-width resin layer 12.

Resin layers 9, small-width resin layers 12 and large-width resin layers 10 may be made of the same material or different materials. Resin layers 9, small-width resin layers 12 and large-width resin layers 10 may be made of, for example, one or more selected from rubber, silicon, PVC (polyvinyl chloride), thermosetting polyurethane, urethane elastomer, polyamide elastomer, polyester elastomer, rubbery elastomer, olefin based elastomer, polyethylene, polypropylene, nylon, EVA (ethylene/vinyl acetate copolymer), and ABS (acrylonitrile/butadiene/styrene copolymer).

In the example illustrated in FIG. 3, each of large-width resin layers 10 and convex region 11 therein are made of the same material; however, these may be made of different materials. For example, convex region 11, which is a relatively thick region, may be made of a material low in hardness than the material of large-width resin layer 10 except convex region 11, which is a relatively thin region. In other words, in the resin layers, the hardness of regions having a high possibility that the regions contact a ball when the ball is caught may be made lower than that of regions having a low possibility that the regions contact the ball. In this way, the ball is easily grasped and caught. In reverse thereto, the hardness of regions having a high possibility that the regions contact a ball when the ball is caught may be made higher than that of regions having a low possibility that the regions contact the ball. In this way, impact given when the ball is caught can be effectively relieved.

About the thicknesses of resin layers 9, small-width resin layers 12 and large-width resin layers 10, these thicknesses may be made equal to each other or different from each other. For example, resin layers 9 may be made thinner than small-width resin layers 12 and large-width resin layers 10, and small-width resin layers 12 may be made thinner than large-width resin layers 10. Furthermore, resin layers 9, small-width resin layers 12 or large-width resin layers 10 themselves may be varied in thickness.

In the example illustrated in FIG. 2, the thickness of resin layers 9 and that of small-width resin layers 12 are made substantially constant while that of large-width resin layers 10 is varied. However, the thickness of resin layers 9 or that of small-width resin layers 12 may be varied. The method for varying the thickness of each of the resin layers is, for example, a method of making concave or convex regions in a surface of the resin layer. In the example illustrated in FIG. 2, concave regions 11 are made in large-width resin layers 10 to vary the thickness of large-width resin layers 10.

As illustrated in FIG. 3, each of large-width resin layers 10 has, at the circumference thereof, a flat region having a flat upper surface. In the example illustrated in FIG. 3, the flat region is formed in a single form. However, this flat region may be divided or partitioned into plural pieces by making one or more slits (gaps), a thin region or the like in this flat region. This makes it possible to increase the number of the slits or the like, thereby bending and deforming resin layer 10 easily to make operations for opening and closing catching tool 1 easy, and further makes it possible to improve the peel strength of convex region 11 and large-width resin layer 12 from ball receiving portion 8*a*.

In the example illustrated in FIG. 3, the thickness of the flat region and that of small-width resin layer 12 are made substantially equal to each other while that of resin layer 9 is made smaller than that of small-width resin layer 12 and that of large-width resin layer 10. Resin layer 9 and small-width resin layer 12 are each made of a flat region having a flat upper surface. Small-width resin layer 12 and large-width resin layer 10 each have, in a slit-side side surface thereof, a flat plane.

As illustrated in FIG. 2, ball receiving member 8 has a thumb region 2*a* that partially constitutes thumb stall 2, a forefinger region 4*a* that partially constitutes forefinger stall 4, a second finger region 5*a* that partially constitutes second finger stall 5, a third finger region 6*a* that partially constitutes third finger stall 6, and a little finger region 7*a* that partially constitutes little finger stall 7. At the root regions of individuals of finger regions 2*a*, 4*a*, 5*a*, 6*a* and 7*a* or near the root regions, small-width resin layers 12 and large-width resin layers 10, which are thick regions, are arranged.

In a case where the thick region of the resin layers is arranged at the root region of at least one of thumb region 2*a*, forefinger region 4*a*, second finger region 5*a*, third finger region 6*a* and little finger region 7*a* or near the root region, the case may be sufficiently satisfied. The thick regions of the resin layers may be arranged around the ball receiving surface.

This manner makes it possible that when a ball is caught, the ball is grasped or surrounded by the thick regions so that the ball is easily caught. Additionally, the slipping of the ball can be effectively restrained at the ball-catching time. In this case, resin layers 9, which are thin regions, are present around the thick regions; therefore, at the ball-catching time, catching tool 1 is easily bent or deformed in portions where resin layers 9, which are thin regions, are formed so that catching tool 1 can be opened and closed. Furthermore, resin layers 9, which are thin regions, are also brought into contact with the ball. Accordingly, the slipping of the ball at the ball-catching time is effectively restrained while the operability of catching tool 1 can be improved.

Figure 4:
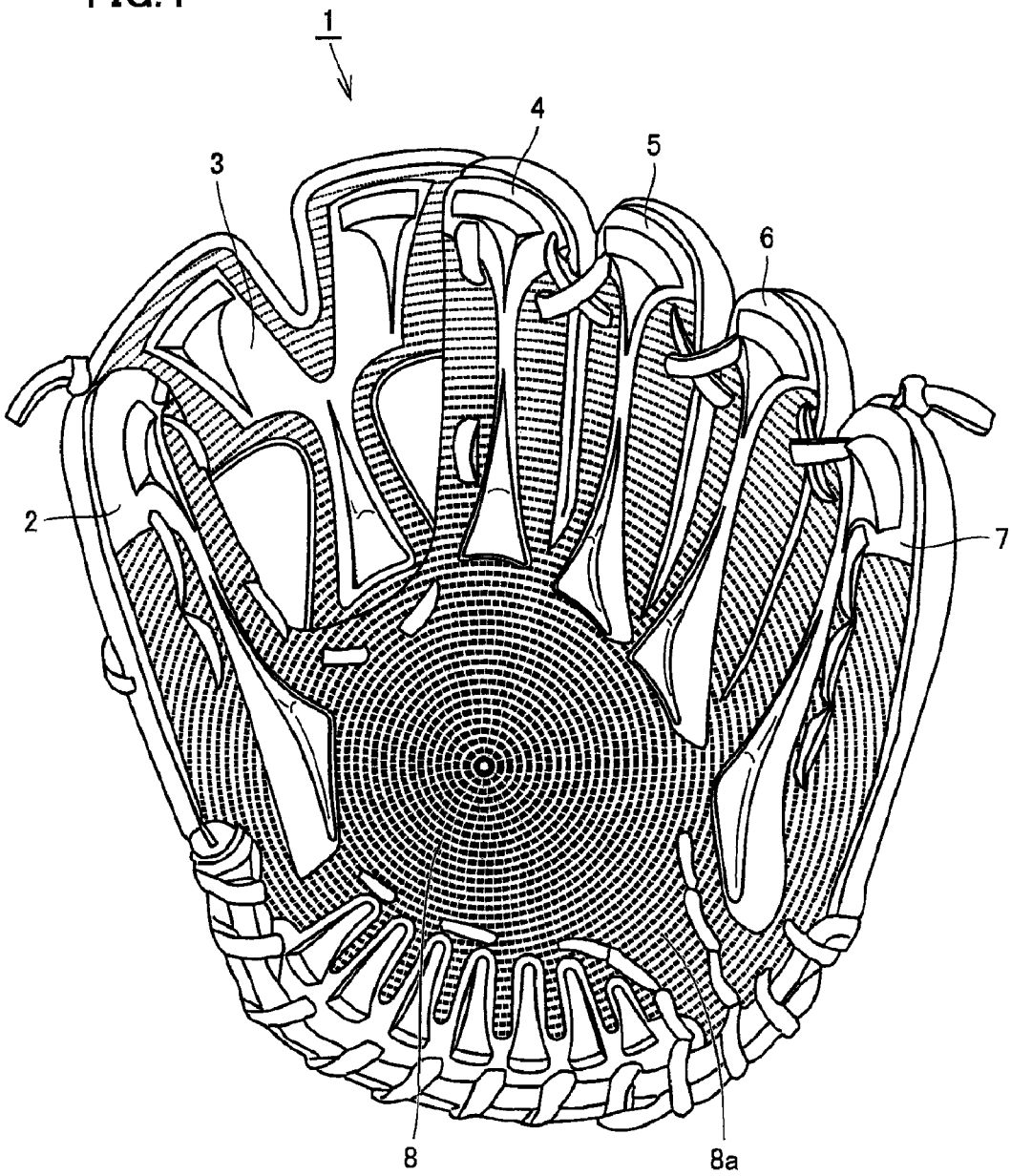
FIG. 4 is a front view illustrating a modified example of the catching tool for baseball or softball of Embodiment 1.
Figure 5:
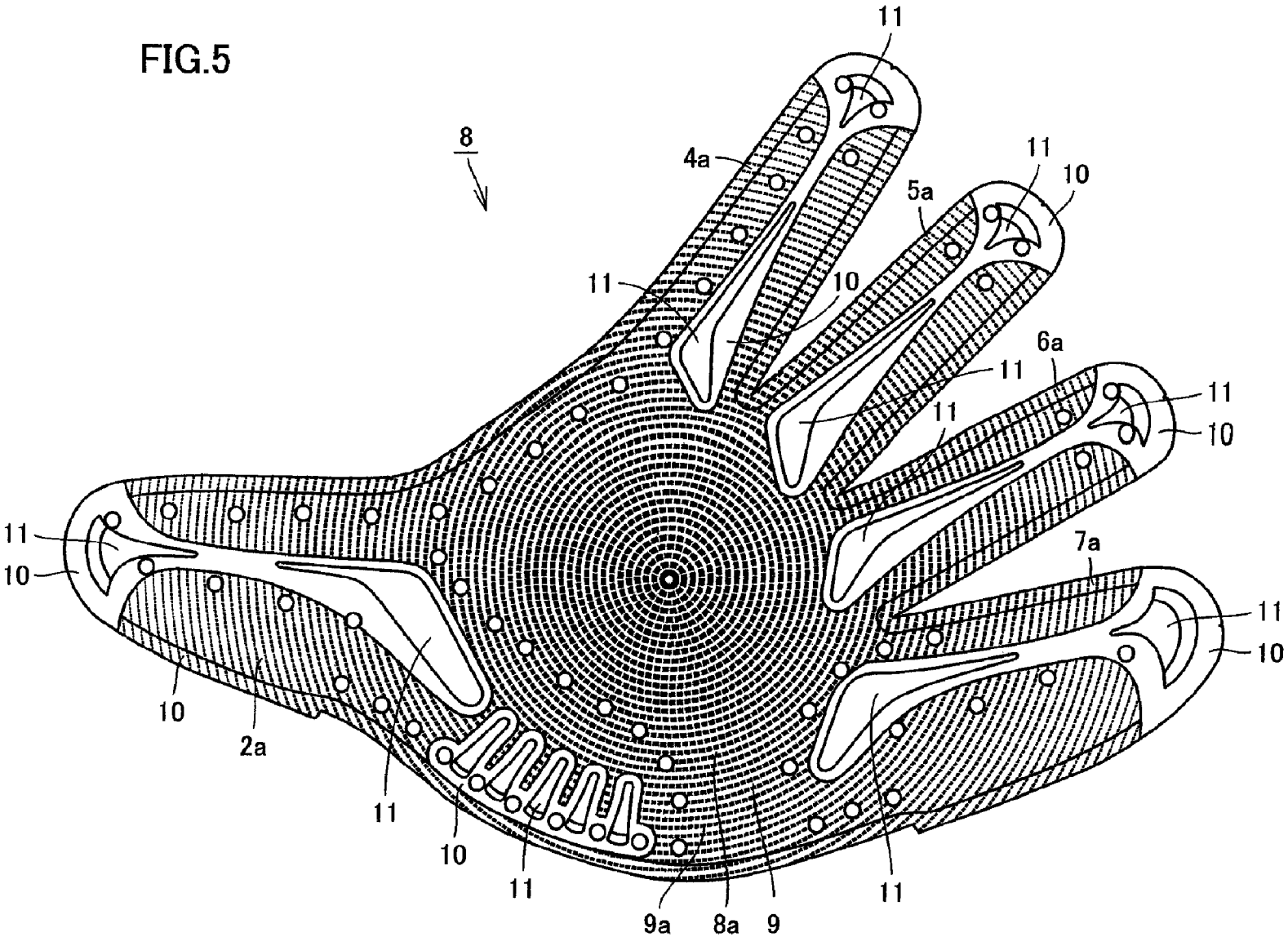
FIG. 5 is a plan view illustrating a state that the ball receiving member of the catching tool illustrated in FIG. 1 is developed.

FIGS. 4 and 5 illustrate a modified example of catching tool 1 according to Embodiment 1. In FIGS. 4 and 5, openings 9*a* in mesh-form resin layers 9 are colored in black for the convenience of the illustration.

As illustrated in FIGS. 4 and 5, openings 9*a* in a substantially rectangular form may be made in resin layers 9 and over the whole of resin layers 9. Openings 9*a* may be arranged to be positioned on concentric circles the centers of which are at the center of the ball receiving surface.

In the example illustrated in FIGS. 4 and 5, convex regions 11 and large-width resin layer 10 that are thick regions are formed in each of thumb region 2*a*, forefinger region 4*a*, second middle region 5*a*, third finger region 6*a* and little finger region 7*a* of ball receiving member 8. Convex regions 11 and large-width resin layer 10 are formed to be extended to the longitudinal direction of each of finger regions 2*a*, 4*a*, 5*a*, 6*a* and 7*a*.

Each of entire large-width resin layers 10 is provided with two out of entire convex regions 11. One of convex regions 11 is arranged at the root region of each of finger regions 2*a*, 4*a*, 5*a*, 6*a* and 7*a*, or near the root region. The other of convex regions 11 is arranged at the tip region of each of finger regions 2*a*, 4*a*, 5*a*, 6*a* and 7*a*, or near the tip region.

As illustrated in FIGS. 4 and 5, resin layers 9, which are thin regions, are arranged on both sides of convex regions 11 and large-width resin layer 10 arranged in each of finger regions 2*a*, 4*a*, 5*a*, 6*a* and 7*a*. In other words, resin layers 9, which are a resin layer pair and are arranged in the width direction of each of finger regions 2*a*, 4*a*, 5*a*, 6*a* and 7*a*, are connected to each other with convex regions 11 and large-width resin layers 10 interposed therebetween. At the circumference of ball receiving portion 8*a* portion positioned between thumb region 2*a* and little finger region 7*a*, convex regions 11 and large-width resin layer 10 are also formed. The structure other than the above is basically the same as in Embodiment 1.

In the present modified example also, openings 9*a* are made in resin layers 9*a*; therefore, when a ball is caught, resin layers 9 can easily be bent so that the force required to open and close catching tool 1 can be decreased. Accordingly, opening and closing operations of catching tool 1 can easily be attained.

Resin layers 9, which are small in thickness, are formed over a wide area of the surface of ball receiving portion 8*a* and further convex regions 11 and large-width resin layers 10 are formed at positions adjacent to resin layers 9; therefore, when a ball is caught, the ball can be brought into contact with convex regions 11 and large-width resin layers 10, and further resin layers 9, which are thin regions, can also be brought into contact with the ball. In this way, at the ball-catching time, the contact area between the ball and the resin layers can be certainly kept. Additionally, at the ball-catching time, the slipping of the ball inside the catching tool can also be effectively restrained. Furthermore, at the ball-catching time, the ball can be grasped with the thick regions, such as convex regions 11 and large-width resin layers 10, so as to be caught; thus, the ball can easily be caught.

As described above, according to the catching tool of the present modified example, at the time of catching a ball, the slipping of the ball inside the catching tool can be effectively restrained while the operability of the catching tool can be improved. Furthermore, the ball can easily be caught in such a manner that the ball is grasped.

Embodiment 2

Figure 6:
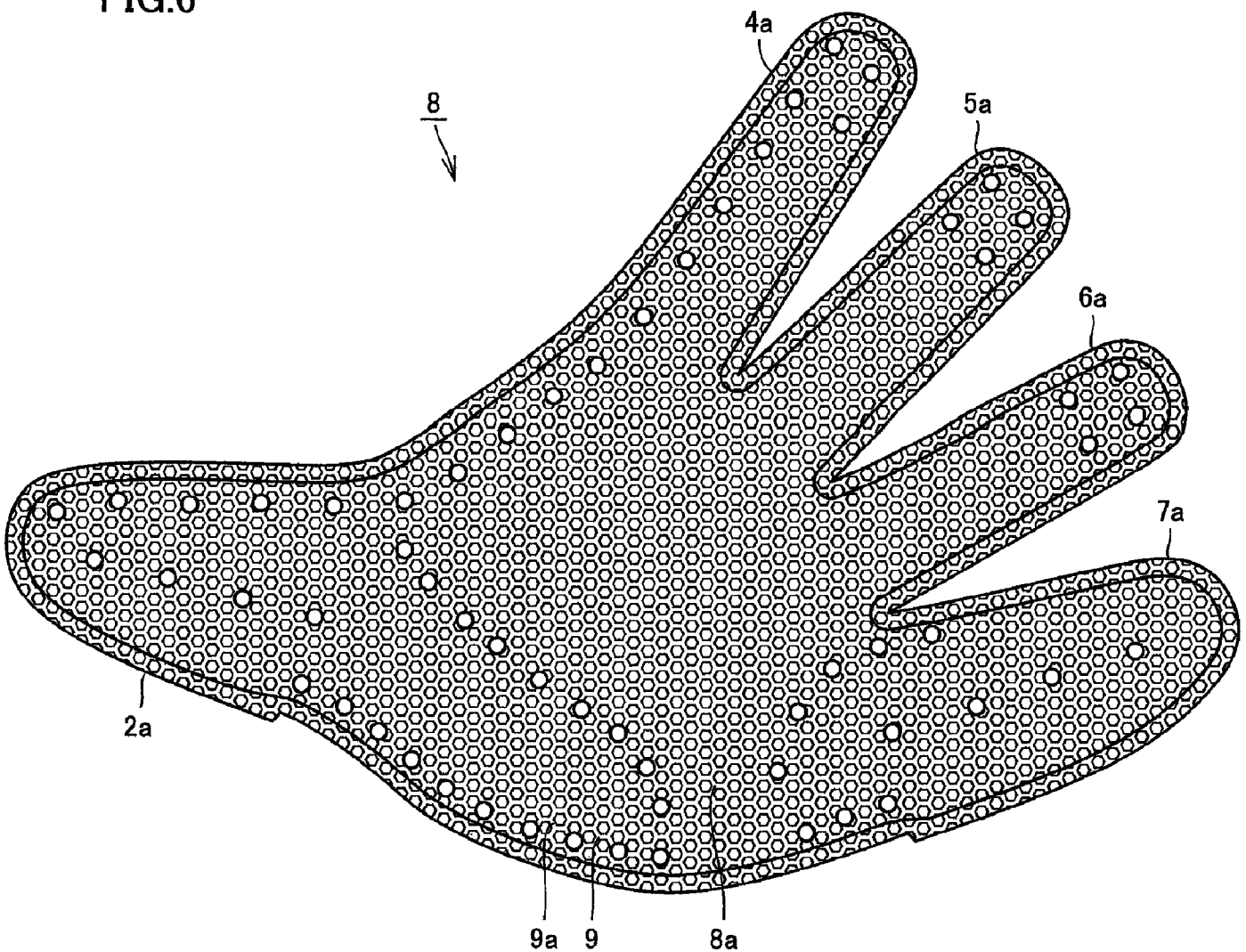
FIG. 6 is a plan view illustrating a state that a ball receiving member of a catching tool for baseball or softball according to Embodiment 2 of the invention is developed.
Figure 7:
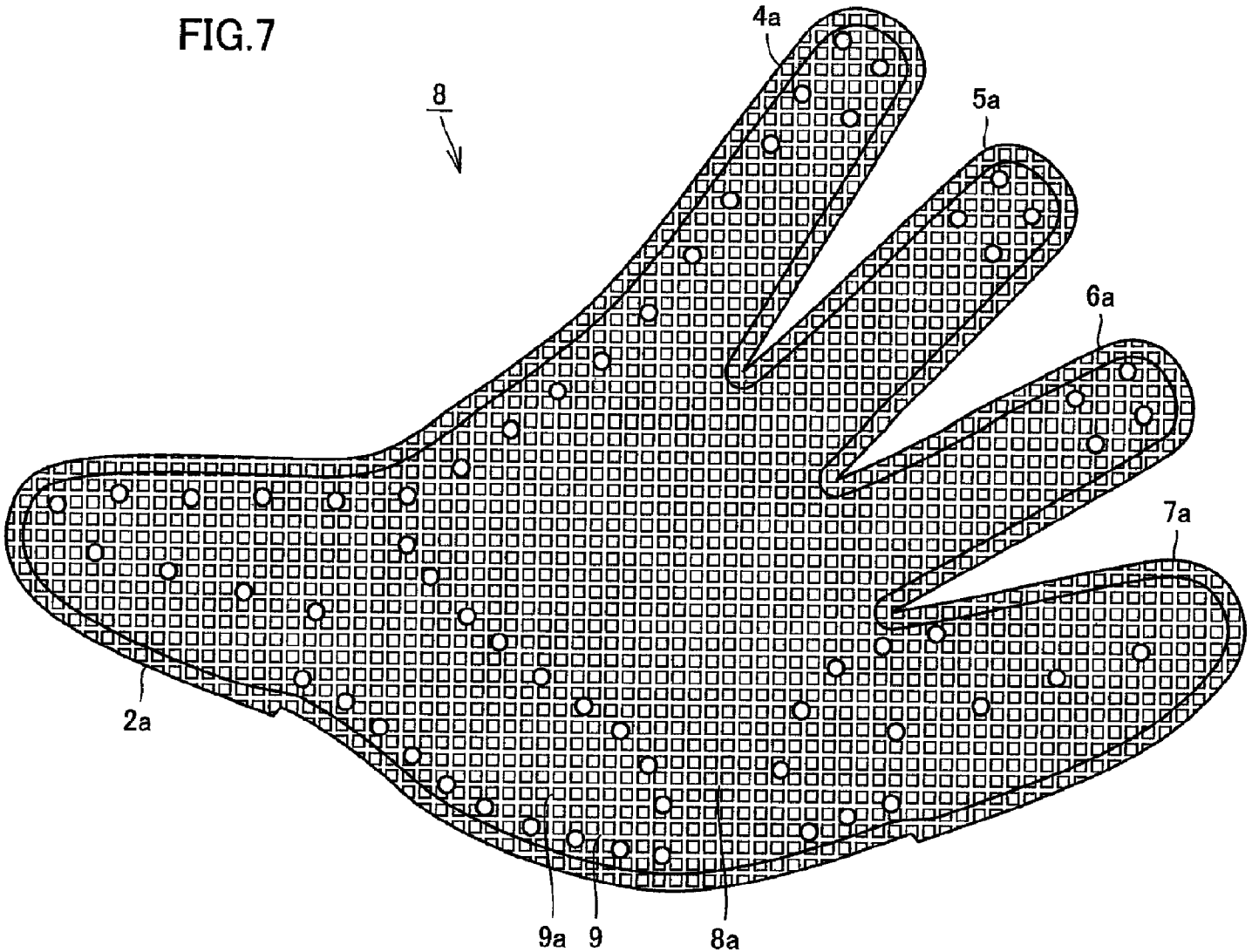
FIG. 7 is a plan view illustrating a state that a ball receiving member in a modified example of the catching tool of Embodiment 2 is developed.

With reference to FIGS. 6 and 7, the following will describe Embodiment 2 of the invention, and a modified example thereof. FIG. 6 is a plan view illustrating ball receiving member 8 of a catching tool according to Embodiment 2 of the invention, and FIG. 7 is a plan view illustrating ball receiving member 8 in a modified example of the catching tool of Embodiment 2.

As illustrated in FIG. 6, in Embodiment 2, only a mesh-form resin layer 9 that has a small thickness is formed over the whole of the surface of ball receiving portion 8*a*; thus, small-width resin layers 12, convex regions 11 and large-width resin layers 10 are not given. In the case of Embodiment 2, resin layer 9 is made of soft resin and openings 9*a* are made in resin layer 9 and over the whole thereof. The thickness of resin layer 9 is preferably made as small as about 0.5 to 1.5 mm.

In the case of Embodiment 2 also, openings 9*a* are made in resin layer 9; therefore, when a ball is caught, catching tool 1 can easily be bent with resin layer 9. In this way, the force required to open and close catching tool 1 can be decreased, and the force required to grasp the ball can be decreased at the ball-catching time.

Since resin 9, which is small in thickness, is formed over the wide area of the surface of ball receiving portion 8*a*, resin layer 9 can easily be deformed along the ball at the ball-catching time so that the ball can be surrounded by resin layer 9 so as to be caught. As a result, at the ball-catching time, the contact area between the ball and resin layer 9 can be made large so that the slipping of the ball can be effectively restrained at the time. Accordingly, the operability of the catching tool can be improved while the slipping of the ball can be effectively restrained at the ball-catching time.

As illustrated in FIG. 7, resin layer 9 may be made into a lattice-form resin pattern. In this case also, the same advantageous effects as in the case illustrated in FIG. 6 can be produced. Openings having irregular shapes may be made in resin layer 9 and over the whole thereof. In this case, the degree that resin 9 is easily bent (deformed) can be controlled by, for example, the sizes of openings 9*a*.

In Embodiment 2, the shape and the size of openings 9*a* may be changed at will. For example, openings 9*a* may be connected to each other to make openings 9*a* relatively large. At the root region of at least one of thumb region 2*a*, forefinger region 4*a*, second finger region 5*a*, third finger region 6*a* and little finger region 7*a* or near the root region, slender openings 9*a* extending the width direction of the finger region may be made. In this way, resin layer 9 can be more easily deformed. However, in order to keep the adhesion strength of resin layer 9 to ball receiving portion 8*a* certainly, it would be advisable not to make openings 9*a* extremely large.

The thickness of resin layer 9 may be varied. For example, the thickness of a portion of resin layer 9 that is positioned at the root region of at least one of thumb region 2*a*, forefinger region 4*a*, second finger region 5*a*, third finger region 6*a* and little finger region 7*a* or near the root region may be made larger than the thickness of portions of resin layer 9 other than the resin layer portion.

Embodiment 3

Figure 8:
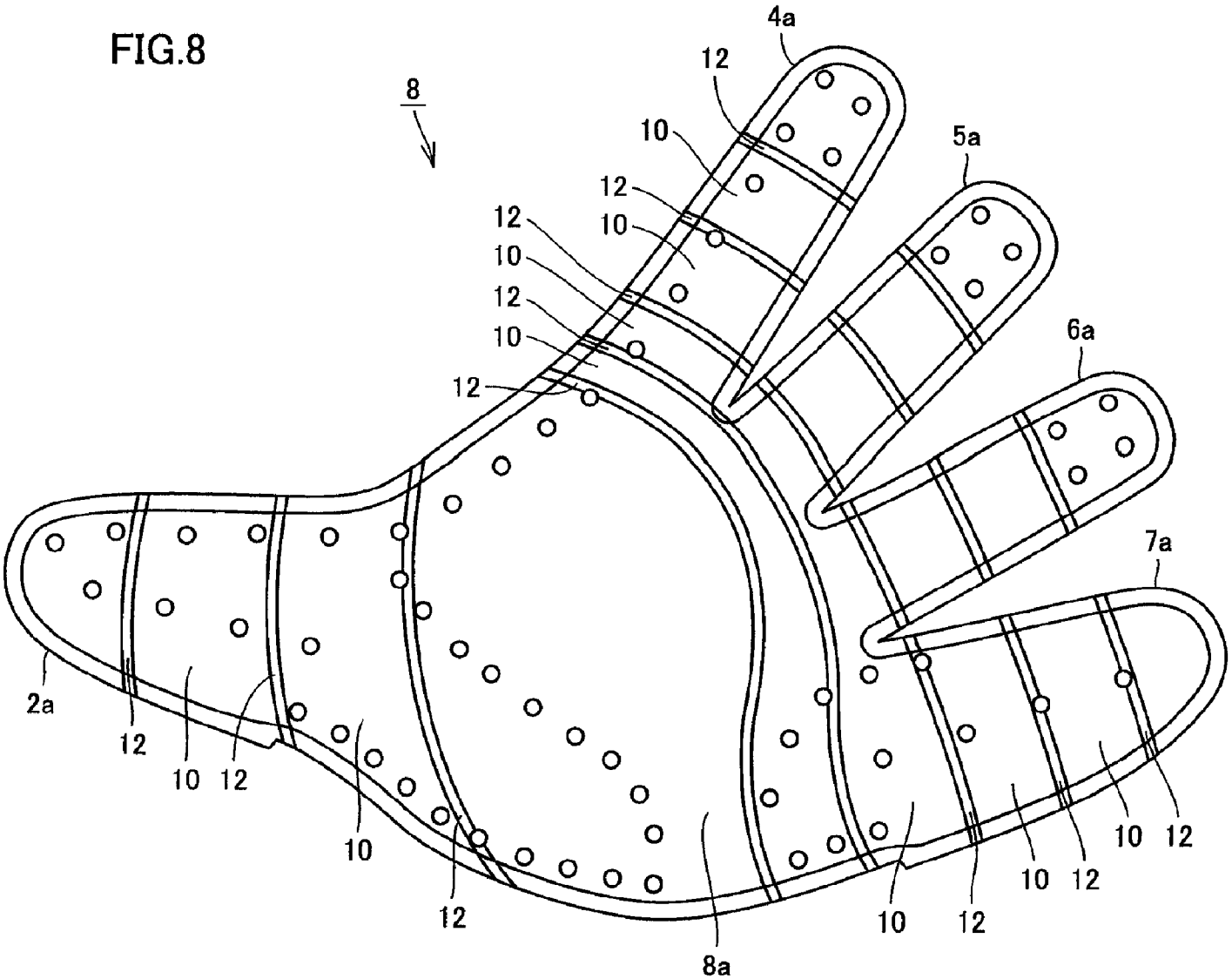
FIG. 8 is a plan view illustrating a state that a ball receiving member of a catching tool for baseball or softball according to Embodiment 3 of the invention is developed.
Figure 9:
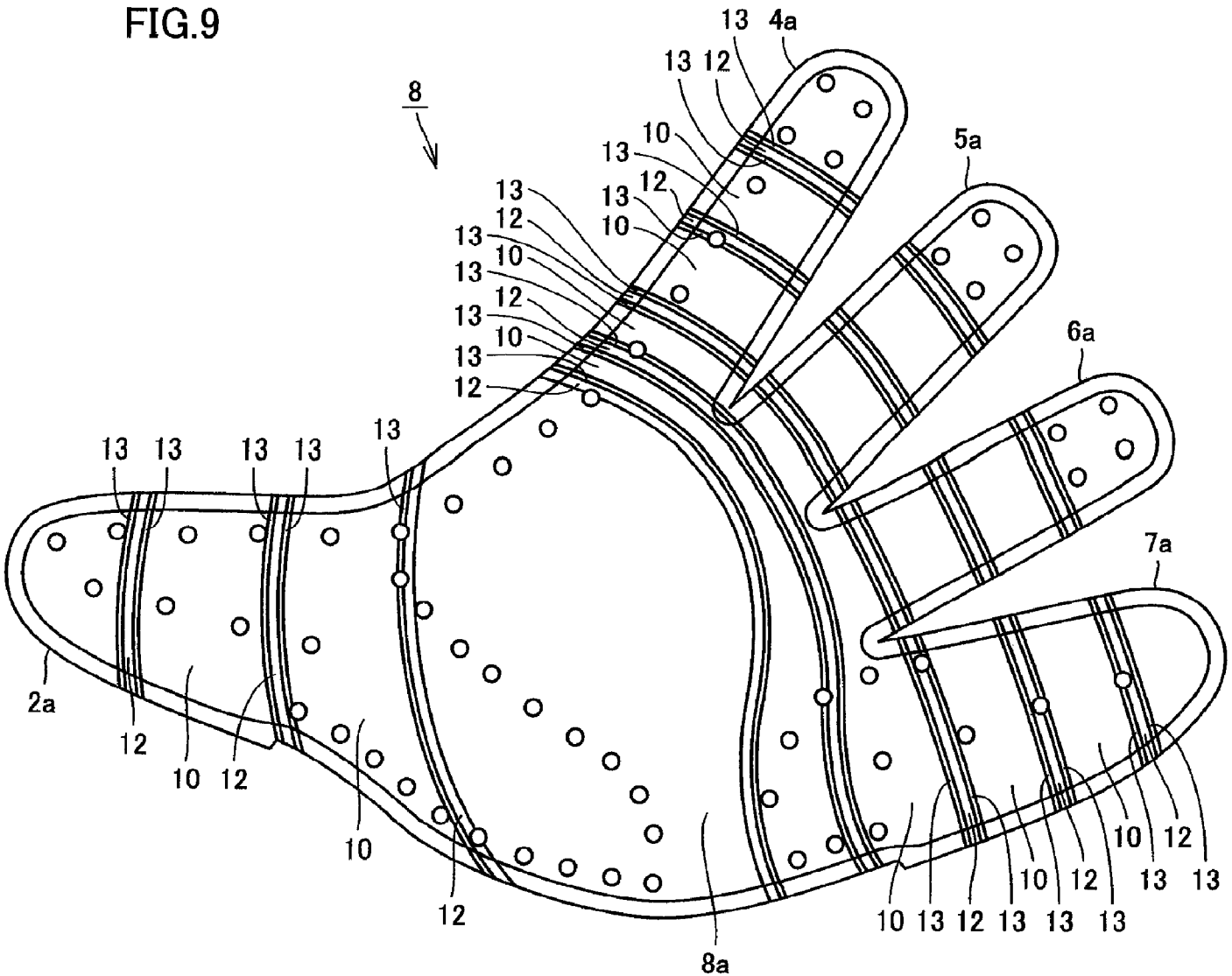
FIG. 9 is a plan view illustrating a state that a ball receiving member in a modified example of the catching tool of Embodiment 3 is developed.
Figure 10:
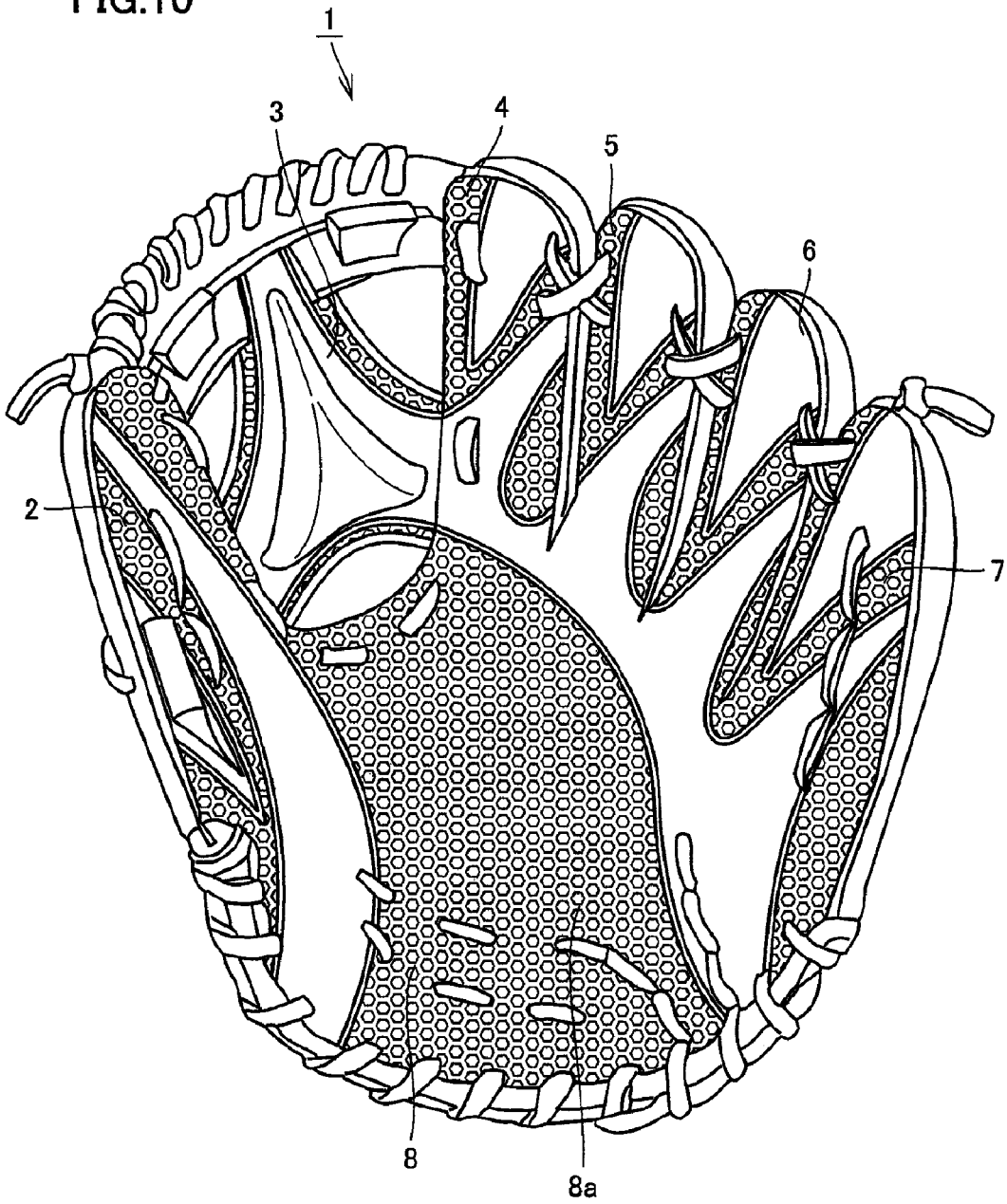
FIG. 10 is a front view of a modified example of the catching tool for baseball or softball illustrated in FIG. 1.
Figure 11:
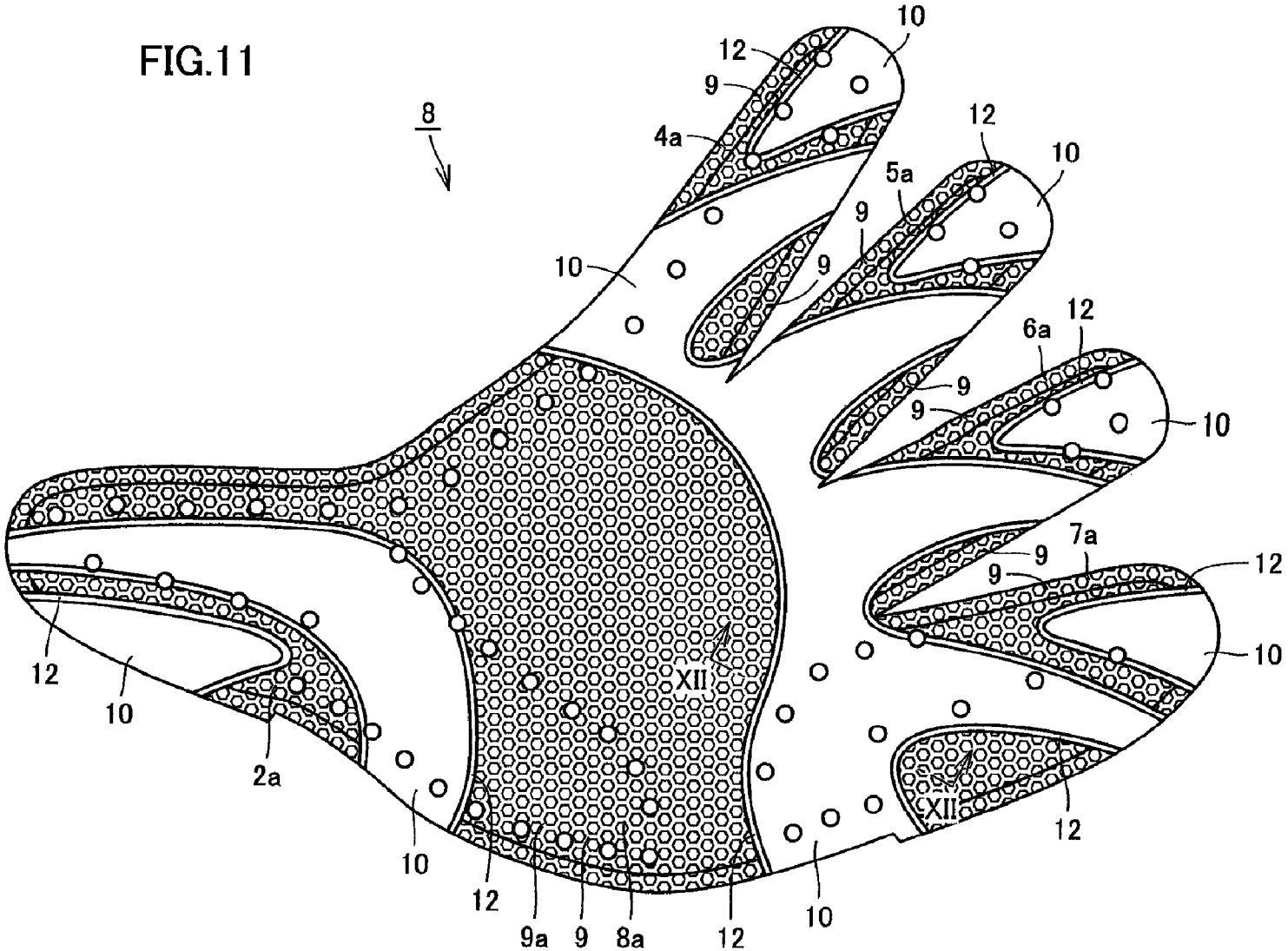
FIG. 11 is a plan view illustrating a state that a ball receiving member of the catching tool illustrated in FIG. 10 is developed.
Figure 12:
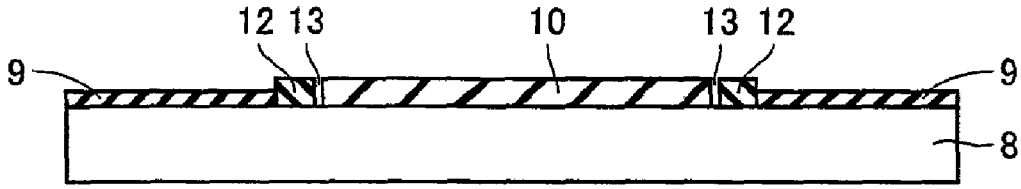
FIG. 12 is a view schematically illustrating a cross section structure of the catching tool taken along line XII-XII in FIG. 11.

With reference to FIGS. 8 and 9, Embodiment 3 of the invention and a modified example thereof will be described hereinafter. FIG. 8 is a plan view illustrating ball receiving member 8 of a catching tool according to Embodiment 3 of the invention, and FIG. 9 is a plan view illustrating ball receiving member 8 in a modified example of the catching tool of Embodiment 3.

As illustrated in FIG. 8, in Embodiment 3, large-width resin layers 10 are formed at intervals on the surface of ball receiving portion 8*a*. Small-width resin layers 12 are made on both sides of each of large-width resin layers 10. The thickness of large-width resin layers 10 may be varied by, for example, arranging the same convex regions 11 as in Embodiment 1 in large-width resin layers 10.

Large-width resin layers 10 and small-width resin layers 12 may be the same or different in thickness, raw material, hardness, and other characteristics. For example, large-width resin layers 10 may be thicker than small-width resin layers 12, or may be thinner than small-width resin layers 12. Large-width resin layers 10 may be made of raw material having a larger hardness than that of small-width resin layers 12, or may be made of raw material having a smaller hardness than that of small-width resin layers 12.

In the example illustrated in FIG. 8, large-width resin layers 10, as well as small-width resin layers 12, are formed in a number of two or more at intervals from the vicinity of the root region of each of thumb region 2*a*, forefinger region 4*a*, second finger region 5*a*, third finger region 6*a* and little finger region 7*a* toward the vicinity of the tip of the finger region; however, large-width resin layers 10 and small-width resin layers 12 may be provided at least one of finger regions 2*a*, 4*a*, 5*a*, 6*a* and 7*a*. Large-width resin layers 10 and small-width resin layers 12 may be arranged on both sides of the central region of ball receiving surface; however, large-width resin layers 10 and small-width resin layers 12 may be formed to surround the ball receiving surface. Furthermore, the shape of large-width resin layers 10 and that of small-width resin layers 12 may be selected at will. Large-width resin layers 10 may be made into band-form patterns as illustrated in FIG. 8; however, for example, large-width resin layers 10 may be made into rectangularly planar patterns. In this case, small-width resin layers 12 may be formed to surround large-width resin layers 10.

In Embodiment 3, neither large-width resin layers 10 nor small-width resin layers 12 are formed in the central region of the ball receiving surface; thus, the present embodiment turns into a state equivalent to the state that large openings are made in the central region of the ball receiving surface. Moreover, the plural resin patterns are formed. For these reasons, in the same manner as in the above-mentioned embodiments, the catching tool can easily be bent together with the resin layers when a ball is caught. Accordingly, the force required to open and close catching tool 1 can be decreased so that the force required to grasp the ball can be decreased at the ball-catching time.

Boundaries are present between large-width resin layers 10 and small-width resin layers 12. At the ball-catching time, therefore, large-width resin layers 10 and small-width resin layers 12 can easily be deformed along the ball so that the contact area between the ball and the resin layers can be certainly kept at the time. As a result, the slipping of the ball can be effectively restrained at the time. Accordingly, the operability of the catching tool can be improved while the slipping of the ball can be effectively restrained when catching a ball.

As illustrated in FIG. 9, thin regions, or slits (gaps) 13 may be arranged between each of large-width resin layers 10 and small-width resin layers 12 adjacent thereto. In this case, large-width resin layers 10 and small-width resin layers 12 can be more easily deformed, and further the peel strength of large-width resin layers 10 and that of small-width resin layers 12 can be improved. The thin regions or slits 13 may be selectively arranged inside large-width resin layers 10 or small-width resin layers 12 and may be arranged between large-width resin layer 10 and small-width resin layer 12.

Each of the above-mentioned embodiments may be appropriately modified. For example, as illustrated in FIGS. 10 to 13, convex regions 11 may be eliminated from the embodiment illustrated in FIGS. 1 to 3. The positions where convex regions 11 illustrated in FIGS. 1 to 3 are formed may be appropriately changed. For example, convex regions 11 may be formed only in thumb region 12, or may be formed at any one or two of second finger stall 5, third finger stall 6 and little finger stall 7.

The above has described some of embodiments of the invention; about the structures of the above-mentioned individual embodiments, it is originally intended that two or more thereof may be appropriately combined with each other. One or more parts of the structures of the individual embodiments may be appropriately eliminated.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A catching tool for baseball or softball, comprising:

a ball receiving portion covering the palm side of a user's hand when wearing the tool, and containing a ball receiving surface for receiving a ball, first and second resin layers selectively formed only on an outer surface of said ball receiving portion, and a back portion covering the back of the user's hand;

wherein the ball receiving portion, first resin layer, and second resin layer are deformable along a surface of the ball when catching the ball.

2. The catching tool for baseball or softball according to claim 1, wherein said first and second resin layers each contain a linear resin layer formed in a linear form.

3. The catching tool for baseball or softball according to claim 1, wherein said first and second resin layers each contain a planar resin layer formed in a planar form.

4. The catching tool for baseball or softball according to claim 1, further comprising a third resin layer connecting said first and second layers, the third resin layer being formed between the first and second resin layers.

5. The catching tool for baseball or softball according to claim 4, wherein at least one of said first, second and third resin layers contains, at the circumference thereof, a flat region having a flat upper surface.

6. The catching tool for baseball or softball according to claim 5, wherein a slit is provided in said flat region, thereby dividing the flat region into plural divisions.

7. The catching tool for baseball or softball according to claim 4, wherein the thicknesses of said first and second resin layers are different from that of said third resin layer.

8. The catching tool for baseball or softball according to claim 4, comprising plural finger stalls for receiving the user's thumb, and the user's fingers other than the thumb, respectively, wherein the thickness of said third resin layer is larger than the thicknesses of said first and second resin layers, and said third resin layer is arranged at the root region of at least one of said finger stalls.

9. The catching tool for baseball or softball according to claim 4, wherein the material of said first and second resin layers is different from that of said third resin layer.

10. The catching tool for baseball or softball according to claim 1, further comprising a third resin layer formed between said first and second resin layers, wherein a slit is provided between said resin layers, or in said resin layers.

11. A catching tool for baseball or softball, comprising:

a ball receiving portion covering the palm side of a user's hand when wearing the tool and containing a ball receiving surface for receiving a ball, a resin layer formed over the whole of the surface of said ball receiving portion, and having an opening that exposes a portion of the surface of said ball receiving portion and is capable of reducing force required when the ball is grasped in the case of catching the ball, and a back portion covering the back of the user's hand wherein said resin layer contains first and second resin layers positioned on both sides of said opening, and said first and second resin layers each have a flat plane at side surface positioned on the side of said opening.

12. The catching tool for baseball or softball according to claim 11, comprising plural finger stalls for receiving the user's thumb, and the user's fingers other than the thumb, respectively, said resin layer has a thick region and a thin region, and said thick region is arranged at the root region of said finger stalls.

13. The catching tool for baseball or softball according to claim 11, wherein said resin layer have a thick region and a thin region, and said thick region is arranged around said ball receiving surface.

14. A catching tool for baseball or softball, comprising:

a ball receiving portion covering the palm side of a user's hand when wearing the tool and containing a ball receiving surface for receiving a ball, a first resin pattern formed on the surface of said ball receiving portion, a second resin pattern formed on the surface of said ball receiving portion to be separated from said first resin pattern, a subsidiary resin pattern formed between said first and second resin patterns, and capable of restraining excessive deformation of at least one of said first and second resin patterns when catching a ball, and a back portion covering the back of the user's hand.

15. The catching tool for baseball or softball according to claim 14, wherein said subsidiary resin pattern is connected to either one of said first and second resin patterns, and a slit is made between the other of said first and second resin patterns and said subsidiary resin pattern.

* * * * *